US006633478B2

(12) United States Patent
Parisi et al.

(10) Patent No.: US 6,633,478 B2
(45) Date of Patent: Oct. 14, 2003

(54) SYSTEM FOR CONTROLLING AN ELECTROMAGNETIC DEVICE

(75) Inventors: Michael A. Parisi, Fairport, NY (US); Judith L. Hannon, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 304 days.

(21) Appl. No.: 09/837,675

(22) Filed: Apr. 18, 2001

(65) Prior Publication Data

US 2002/0167777 A1 Nov. 14, 2002

Related U.S. Application Data

(60) Provisional application No. 60/227,706, filed on Aug. 24, 2000.

(51) Int. Cl.[7] ..... H01H 47/00
(52) U.S. Cl. ..... 361/154; 361/160
(58) Field of Search ..... 361/154, 160, 361/152

(56) References Cited

U.S. PATENT DOCUMENTS 4,536,818 A 8/1985 Nielsen ..... 361/154
5,744,922 A 4/1998 Neary et al. ..... 318/293
6,249,418 B1 * 6/2001 Bergstrom ..... 361/152

* cited by examiner

*Primary Examiner*—Stephen W. Jackson
*Assistant Examiner*—James Demakis
(74) *Attorney, Agent, or Firm*—Oliff & Berridge, PLC

(57) ABSTRACT

A control circuit is provided for use in an electromagnetic device with a coil where the electromagnetic device is actuated with an actuating current and held in an operative condition by a holding current with the holding current being significantly lower in magnitude than the actuating current. The control circuit includes first and second transistors wherein, during a powered mode, the first transistor is disposed in an on state and the second transistor is disposed in an off state, and, during a shorted mode, the first transistor is disposed in an off state and the second transistor is disposed in an on state. Additionally, a power source selectively communicates with the coil, and during a first time interval, the power source communicates with the coil in the powered mode and, during a second time interval, the power source is disconnected from the coil in the shorted mode.

9 Claims, 7 Drawing Sheets

SYSTEM FOR CONTROLLING AN ELECTROMAGNETIC DEVICE

This application is based on a Provisional Patent Application No. 60/227,706, filed Aug. 24, 2000.

FIELD OF THE INVENTION

The present invention relates to a control circuit for varying the magnitude of a holding current in an electromagnetic device with a coil where the electromagnetic device is actuated with an actuating current and held in an operative condition by the holding current.

BACKGROUND OF THE INVENTION

A coil of wire forms an inductor. An inductor resists changes in current. They store energy in the form of a magnetic field that is produced by the current passing through the inductor. Any change in this current induces a voltage that opposes the change in the current. The inductance of the inductor is proportional the number of turns in the coil and the permeability of the material surrounding the coil. Permeability is the ability of a materiel to concentrate magnetic flux. Higher permeability magnetic materials result in higher inductance values and lower permeability materials result in lower inductance. Air has a permeability of one and iron materials have higher permeability.

Inductors have properties of inductance and resistance. The DC resistance of the coil is determined by the resistance of the wire used in the coil. The number of turns in the coil and the Permeability of the media surrounding the coil determine the inductance.

The current in an inductor rises exponentially when a fixed DC voltage is applied across its terminals. Ohm's law determines the steady state current given a value of the DC voltage and the resistance of the coil. The initial current is zero, and its rate of change is determined by the inductance of the coil. Closure of the switch in FIG. 1 results in the exponential current profile shown in FIG. 2. The equation for this response is:

$$i(t) = \frac{v}{R}\left(1 - e^{-t\frac{R}{L}}\right)$$

where:

v is the DC voltage across the coil

R is the resistance of the coil

L is the inductance of the coil i is the current through the coil t is time from the application of v.

A relay, solenoid and magnetic clutch are constructed using an electrical magnet that actuates an armature to initiate a function. The relay armature when actuated opens or closes electrical contacts. The solenoid when actuated effects some movement to engage or disengage a mechanism. The actuation of the armature in these devices is caused by the magnetic field developed by current passing through a coil of wire. Normally the coil is wound on a spool that is then placed within a magnet core that concentrates the magnetic field. This core has a gap in the magnetic path where the armature is located. Here is where the magnetic field attracts the armature and the armature moves in an effort close the gap.

FIG. 3 shows a relay coil with the spool an core and mounting bracket and an armature. The gap is between the armature and the pole peace on the top of the spool. When sufficient current flows through the coil the armature is pulled down to the pole piece in a manner indicated by the arrow in FIG. 3.

Constructing a simple circuit such as in FIG. 1 and plotting the current from the battery results in a response similar to that of FIG. 2. That is until the magnetic field has grown strong enough to acute the armature. The actuation of the armature closes the gap in the magnetic field changing the effective permeability of the core resulting in a change in inductance. This disrupts the current vs. time profile. FIG. 4 below is a plot of actual data from a Potter & Blumfield KUP14D15 relay. The triangles mark the actual data and the lines are best-fit curves to those triangles. There are two curves, the one to the left is for 6.1 mh (milli-Henry) which is the inductance of the relay coil with the armature open and the right one is for 6.3 mh and is the inductance with the armature closed. These inductances were estimated by fitting the inductive charging equation to the data. "Appendix B" shows the worksheets used to fit this data.

The circled area in FIG. 4 is the area in which actuation accrued. During the time before the circle the armature is attracted by the magnetic field, but its strength is insufficient to overcome the force holding the armature in the open position. Inside the circle is when the armature moves from open to closed. To the right of the circle the armature is in the closed position. Interrupting the current flow will reverse this process and the armature moving to its open position will introduce a similar disruption to the response.

DESCRIPTION OF THE PRIOR ART

The prior art includes control circuits for both stepper motors and solenoids:

U.S. Pat. No. 5,744,922 to Neary et al. ("Neary") discloses a current regulator, the current regulator utilizing a well known driver chip. The driver chip has an input signal known as a brake signal "BRK" which typically is used to stop a standard DC motor. In the disclosed embodiment of Neary, the brake signal "BRK" is used to create a low resistance current path in order to sustain the current of the current regulator which is used in conjunction with a stepper motor.

U.S. Pat. No. 4,536,818 to Nielsen ("Nielsen") discloses a solenoid driver circuit that reduces power consumption by switching a corresponding solenoid coil current during a decay period from an initial peak current to a lower magnitude sustaining peak current. Current decays from the sustaining peak current magnitude for a predetermined length of time to a lower current level. Two transistors and a Zener diode are operatively connected to the solenoid and controlled by a logic circuit to apply the desired current to the solenoid. A sense resistor is coupled in series with the solenoid to sense current in the solenoid. The Zener diode is coupled in parallel with the sense resistor to provide a current decay path from the solenoid parallel to the sense resistor. The two transistors are turned on and off using logic flip-flops to sense voltage comparisons with the initial peak current voltage, the sustaining peak current, and the sustaining low current. A logic signal is generated as a function of the predetermined length of time, and an output signal is coupled to the bases of the two transistors to control their on/off states.

While the stepper motor control approach of Neary is well suited for controlling a stepper motor, it does not appear to be as well suited for controlling an electromagnetic device, such as a solenoid, relay or clutch, where the device is operated at a current that is significantly lower than its "activation" current. Essentially the stepper motor operates at activation current $I_{Ref}$. This approach is inefficient for an electromagnetic device that need not operate at its activation current for significant time periods.

While the control circuit of Nielsen is well suited for use with a solenoid, it does not appear to function optimally as an on/off switch, such as a switch for unlocking a CD-ROM player or automobile door. More particularly, Nielsen is directed toward transmission control and seeks to obtain a means for reducing power dissipation and minimizing non-linearity in solenoid output in response to an input having a duty cycle.

In view of the above, there is a need for an efficient electronic switch that can be used to "crisply" switch a solenoid, relay, clutch or the like from an on state to an off state with a minimum amount of power dissipation.

The disclosures of Neary and Nielsen are incorporated herein by reference.

SUMMARY OF THE INVENTION

In one embodiment of the disclosed invention, there is provided a control circuit for use with an electromagnetic device with a coil. In practice, the electromagnetic device is actuated with an actuating current and held in an operative condition by a holding current with the holding current being significantly lower in magnitude than the actuating current. The control circuit comprises: a first transistor disposable in one of an off state and an on state, said first transistor communicating with said coil; a second transistor disposable in one of an off state and an on state, said second transistor communicating with said coil, wherein during a powered mode, the first transistor is disposed in the on state and the second transistor is disposed in the off state, and, during a shorted mode, the first transistor is disposed in the off state and the second transistor is disposed in the on state; a power source selectively communicating with the coil, wherein, during a first time interval, said power source communicates with said coil in the powered mode and, during a second time interval, said power source is disconnected from said coil in the shorted mode so that current is recirculated by said second transistor; and a switching actuator communicating with said first and second transistors, said switching actuator operating cooperatively with the first and second transistors to transition the holding current from a first magnitude to a second magnitude while maintaining the electromagnetic device in the operative condition.

DETAILED DESCRIPTION OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
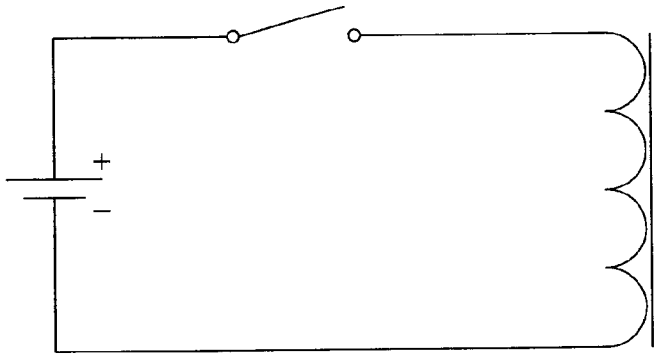
FIG. 1 (PRIOR ART)
FIG. 1 is a schematic view of a circuit in which a power supply is connected to an inductor by way of a switch.
Figure 2:
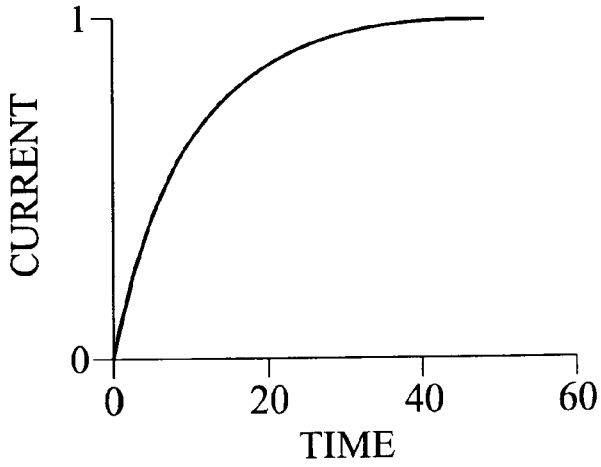
FIG. 2 (PRIOR ART)
FIG. 2 includes a response curve depicting the relationship of current and time when the switch in the circuit of FIG. 1 is in a closed position.
Figure 3:
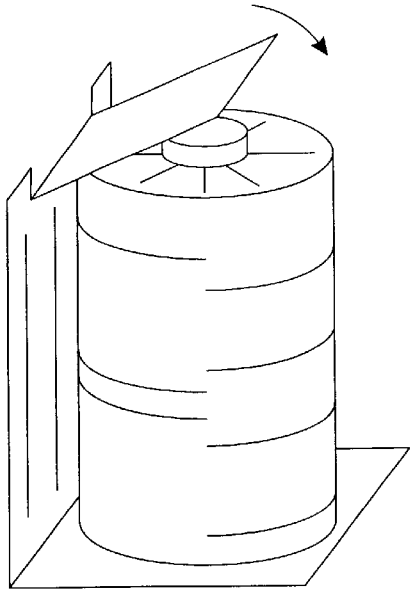
FIG. 3 (PRIOR ART)
FIG. 3 is a perspective view of a relay coil including a spool, core, mounting bracket and armature.
Figure 4:
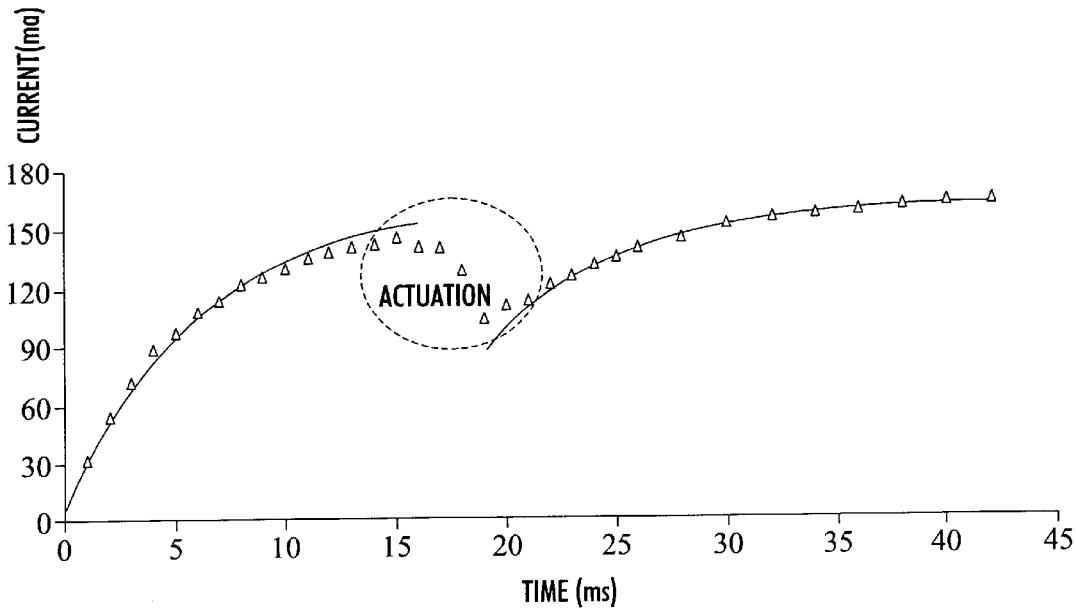
FIG. 4 (PRIOR ART)
FIG. 4 includes a response curve depicting a manner in which the relay coil of FIG. 3 is activated.
Figure 5:
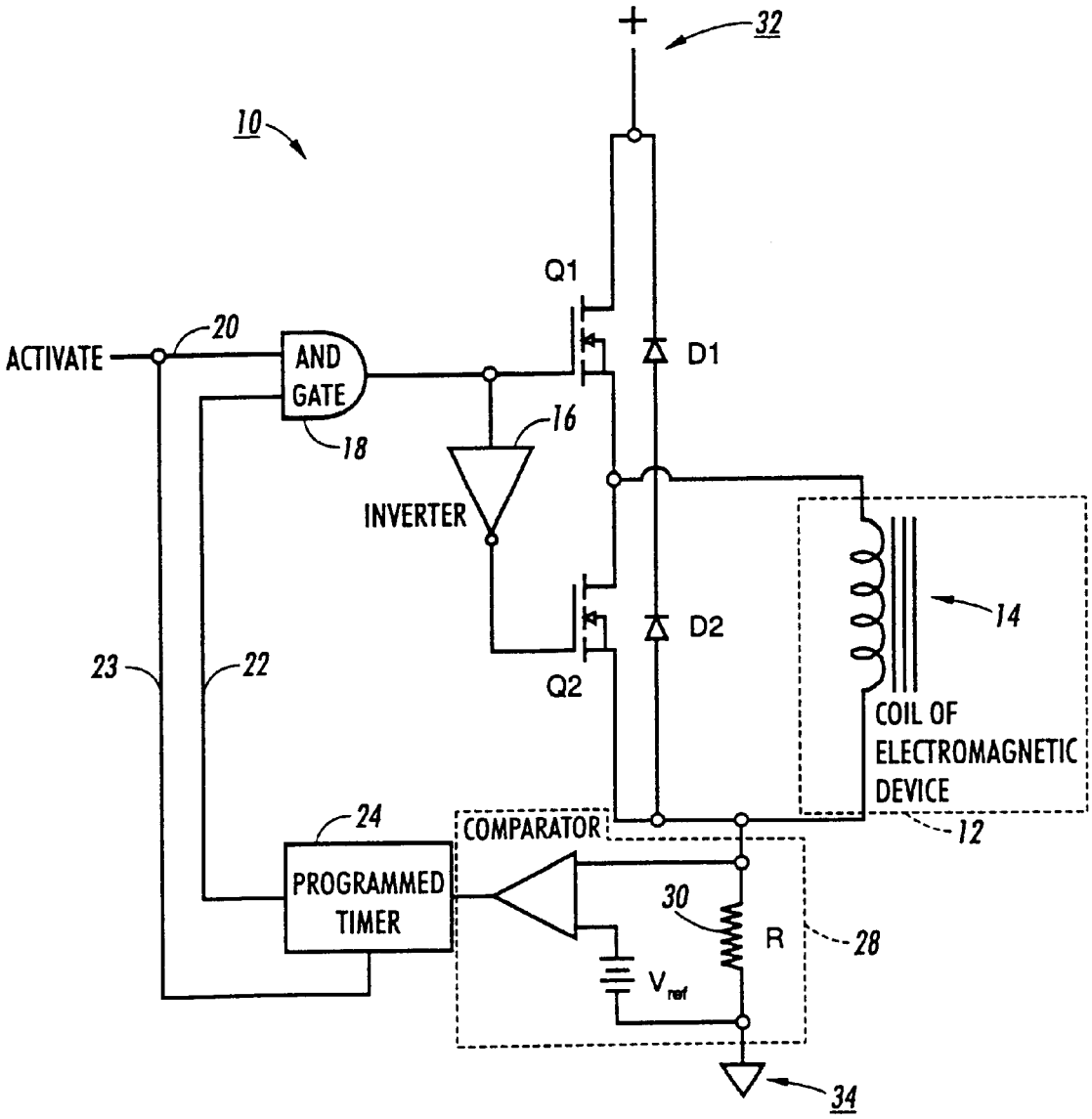
FIG. 5 is a schematic view of a circuit adapted to switch a coil of an electromagnetic device between one of a powered mode and a shorted mode rapidly enough to maintain a corresponding magnetic field at a level required for acceptable operation of the electromagnetic device.

Referring now to FIG. 5, a control circuit suitable for implementing an embodiment hereof is designated with the numeral 10. The control circuit 10 communicates with an electromagnetic device 12, with the device 12 including a coil 14. As contemplated, the electromagnetic device comprises any electromagnetic device in which activation is achieved with a first current and operation is maintained with a second current, where the magnitude of the second current is less than the magnitude of the first current.

The coil 14 is disposed in series with a first transistor $Q_1$, and is disposed in parallel with a second transistor $Q_2$. While each of $Q_1$, and $Q_2$ may comprise one of a variety of transistor types, e.g. bipolar transistor type, in the preferred embodiment each of $Q_1$ and $Q_2$ comprise a MOSFET transistor of the type disclosed in U.S. Pat. No. 5,744,922.

Transistors $Q_1$ and $Q_2$ are disposed in parallel with diodes $D_1$ and $D_2$, respectively. In application, $D_1$ and $D_2$ serve as clamping diodes for controlling the voltage of coil 14 during transition times when the MOSFETs are switched. Additionally, an inverter 16 is configured in such a manner, relative to transistors $Q_1$ and $Q_2$, that $Q_2$ is turned off when $Q_1$ is turned on, and vice versa.

Transistor $Q_1$ and inverter 16 are tied to the output of a logical device (e.g. AND gate) 18, the logical device including inputs 20, 22. An input 23 communicates with a programmed timer 24, the significance of which programmed timer will become apparent from the discussion of circuit timing below. Additionally, the output from the programmed timer 24 is communicated across input line 22.

Referring still to FIG. 5, the logical device 18 operates cooperatively with the programmed timer 24 and a comparator subcircuit 28 for controlling the switching of $Q_1$ and $Q_2$. The comparator subcircuit 28, the comparator subcircuit including a comparator 29 and being connected to sensing resistor (R) 30 and is referenced to $V_{ref}$. The voltage across the sensing resistor "follows" the current through the coil 14 and measures supply current. The comparator provides over and under current signals to the programmed timer—the functionality of the over and under current signals will be made more apparent from the discussion accompanying FIG. 8 below.

The circuit 10 coupled with a conventional power supply where the high end is designated by the numeral 32 and the ground is designated by the numeral 34.

Figure 6:
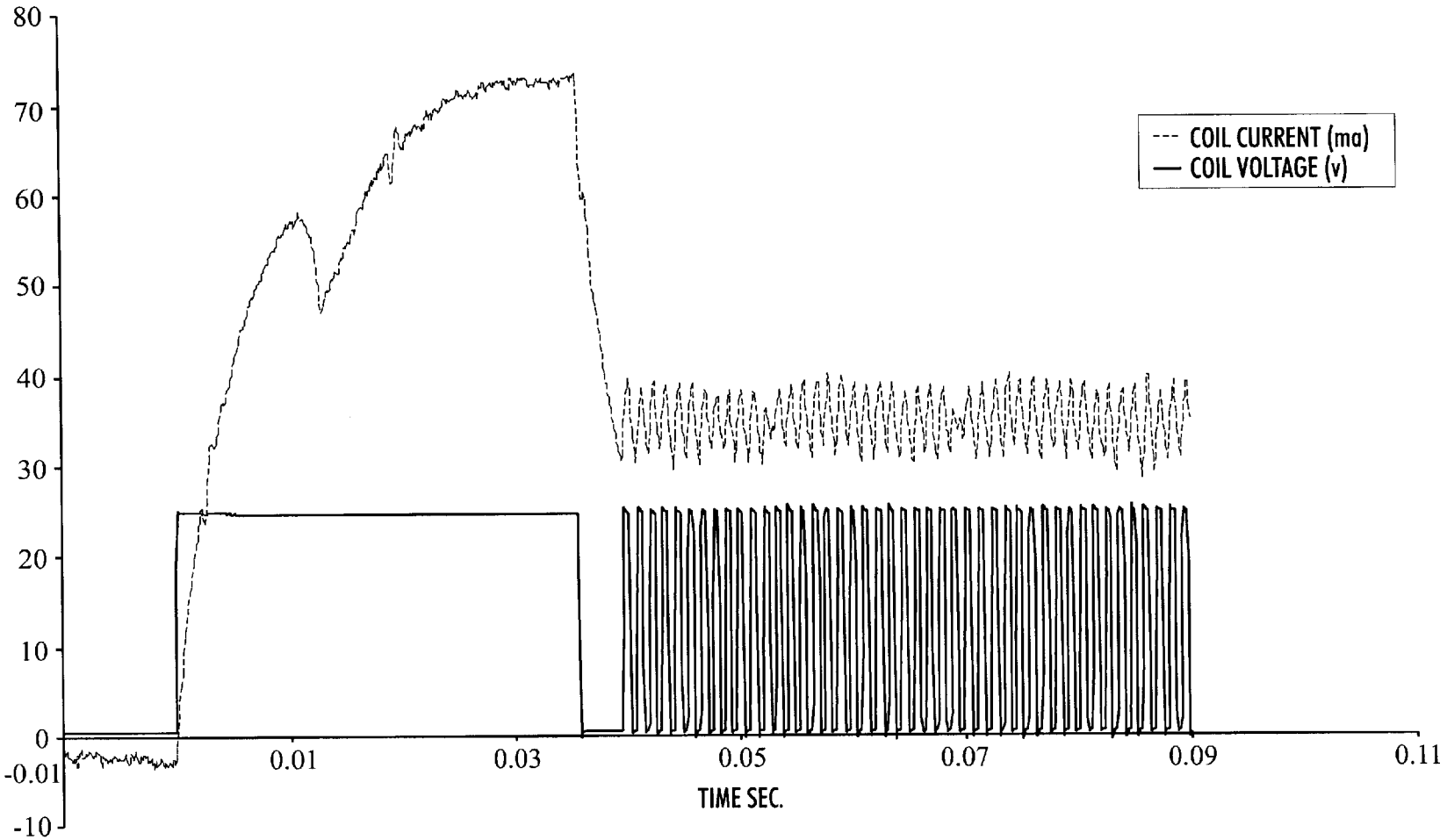
FIG. 6 includes a response curve depicting how a relay is activated with a first current and then maintained with a second current, the second current being switched on and off with the control circuit of FIG. 5.
Figure 7:
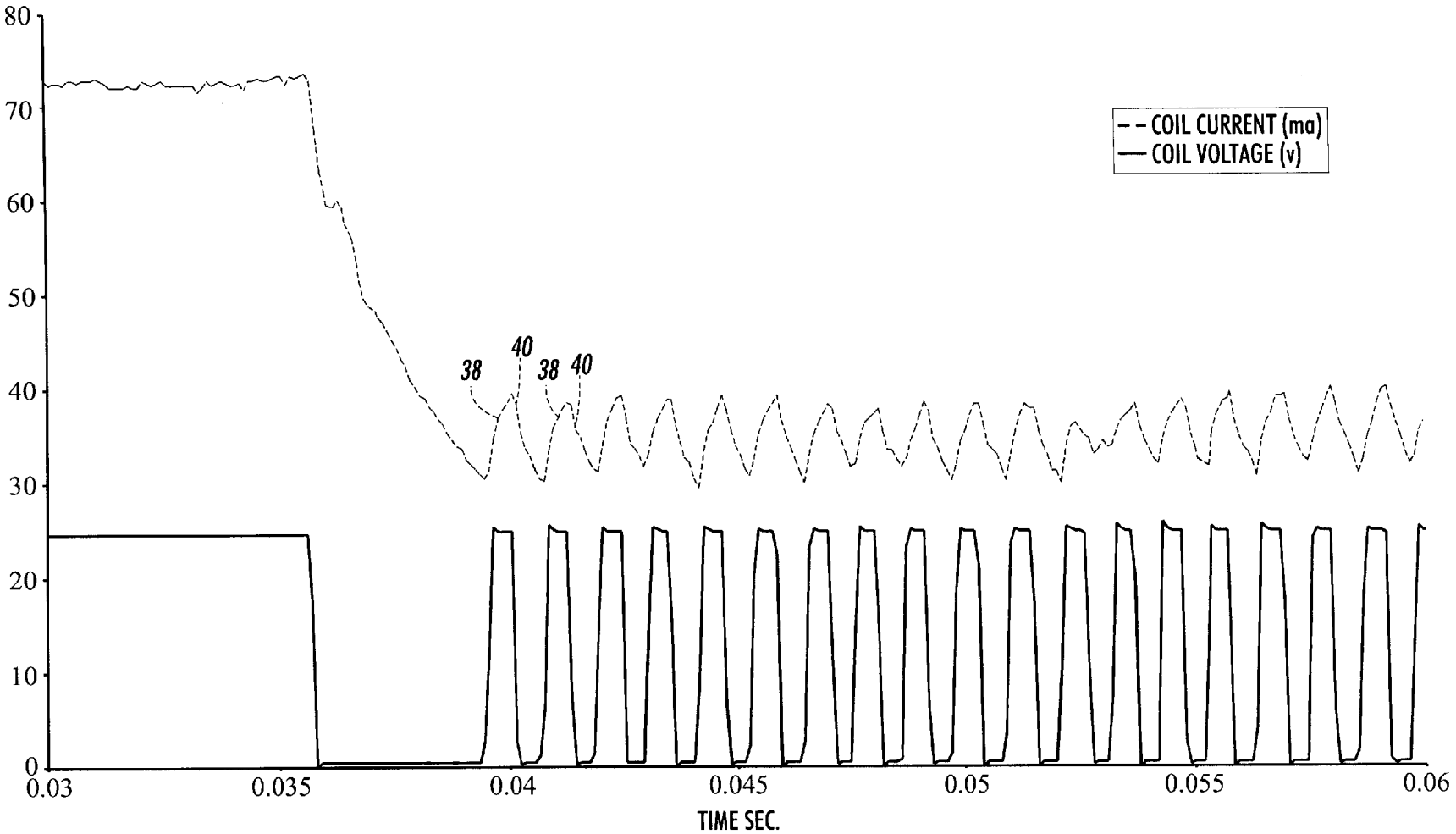
FIG. 7 includes a portion of the response curve of FIG. 6 where the portion is shown in an enlarged form.

Referring specifically to FIGS. 6 and 7, an exemplary response for the embodiment hereof is shown. While the curves of FIGS. 6 and 7 are taken from a relay, such curves could be obtained from any one of a host of electromagnetic devices (including activation and maintenance currents) whose operation is controlled by control circuit 10.

Referring in particular to FIG. 6, an activation curve is shown between 0.00 and about 0.035 seconds. Upon activation (just after 0.035 seconds), the current drops to a maintenance current. The maintenance current is then varied between 30 and 40 milleamps with the circuit 10. A voltage response, corresponding with the current response, is also shown in FIG. 6.

Referring in particular to FIG. 7, the response curve of FIG. 6 is shown in enlarged form. It should be noted that the maintenance current varies about $V_{ref}/R$. In practice, the response for the maintenance current could not be obtained without some sort of mechanism for "spreading out" rising and falling edges. The rising edges are designated with the numeral 38 (FIG. 7) and the falling edges are designated with the numeral 40. In one approach, the programmed timer is used to facilitate the separation of rising and falling edges (see FIG. 8 and accompanying description below) so as to permit appropriate operation of transistors within rated frequency range. More particularly, through use of a suitable delay, switching rate can be controlled to facilitate the "spreading out".

Figure 8:
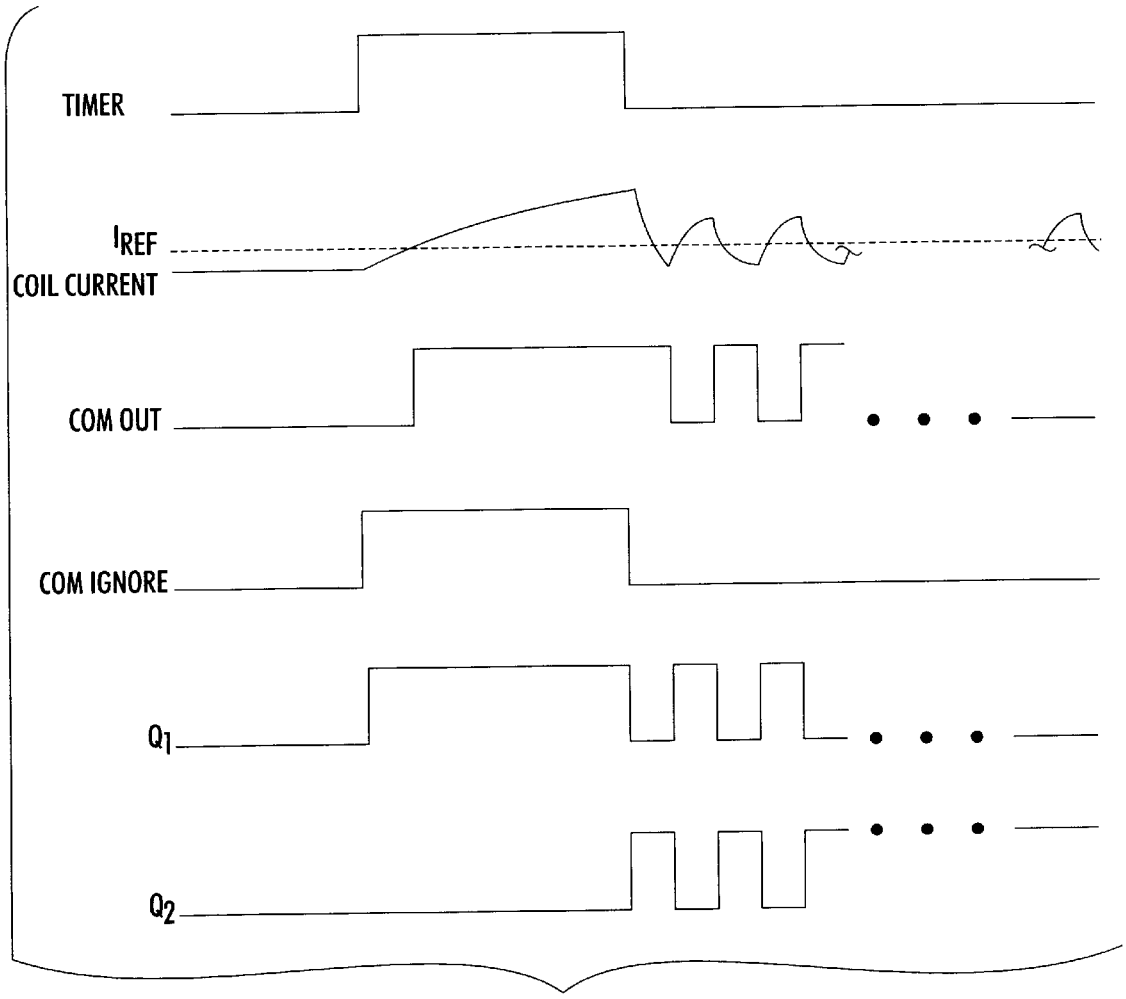
FIG. 8 is a timing diagram depicting a mode of operation for a relay controlled with the control circuit of FIG. 5.

Referring to FIGS. 5–8, the operation of circuit 10 is discussed in further detail. For ease of reference, the response of the coil current is shown along with the timing curves of FIG. 8. In operation, an activation signal is provided initially at input 20 and, in response to a signal across line 23, a logical high output is provided from the programmed timer 24 along input 22. In turn, the "Timer" (FIG. 8), "ComIgnore" (comparator ignore) and $Q_1$ signals all go high. Under normal circumstances, the signal for $Q_1$ would remain low while "ComOut" (comparator out) is high. However, as shown in FIG. 8, $Q_1$, remains high as long as ComIgnore is high. This permits the coil 14 (FIG. 5) to remain in a powered mode until both ComIgnore and ComOut go low.

It should be understood that ComOut varies as a function of the voltage across the resistor 30 (namely $V_R$) and $V_{ref}$ so that, If $V_R<V_{ref}$ then ComOut is low,
and If $V_R>V_{ref}$ then ComOut is high.

Referring still to FIG. 8, as soon as ComIgnore goes low, $Q_1$ goes low (because ComOut is high) and Q2 goes high. When Q2 is switched on (to initiate a shorted mode), the voltage of $V_R$ starts to drop. When $V_R$ is less than $V_{ref}$, ComOut goes low so that Q1 goes high to reinitiate the powered mode. ComOut will alternate periodically between high and low because of the above-described fluctuation in $V_R$ and $V_{ref}$.

Figure 9:
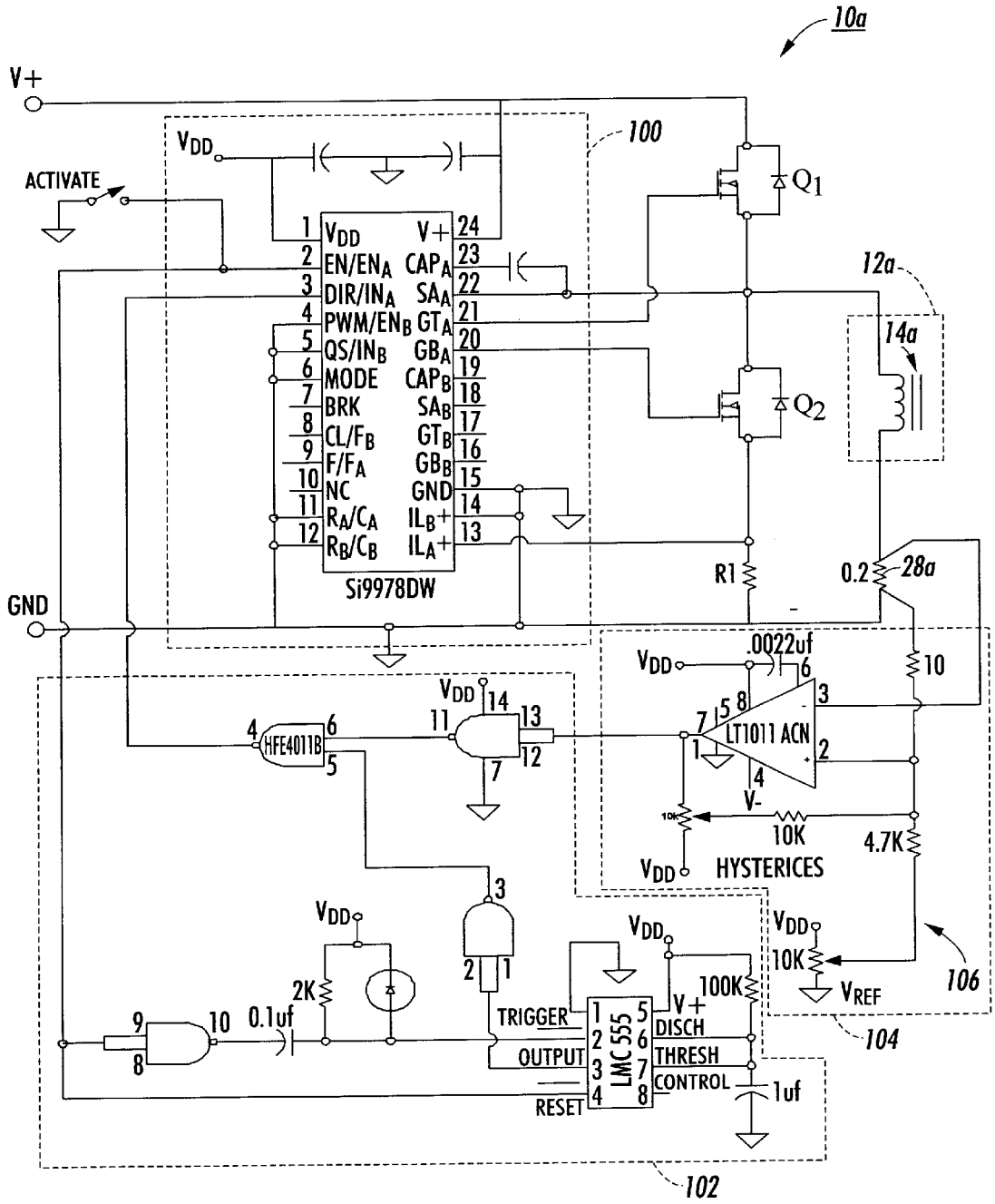
FIG. 9 is a schematic view of a circuit representing a reduction-to-practice of the circuit shown in FIG. 5.

Referring to FIG. 9, a circuit 10*a* was developed to demonstrate the viability of the generalized circuit of FIG. 5. It will be appreciated by those skilled in the art that the circuit of FIG. 5 does not address a variety of operational details, e.g. practical implementation of the inverter 16. Many of these operational details are more specifically addressed by the circuit 10*a*. The circuit 10*a* was constructed with readily available parts and provided functionality consistent with the response of FIG. 6. The following description permits correlation between circuit 10 (FIG. 5) and circuit 10*a:*

Coil 14*a* (part of electromagnetic device 12*a*) is shown in communication with (1) $Q_1$ and $Q_2$, and (2) sense resistor 28*a*.

The inverter 16 and logical device 18 are implemented with a logical subcircuit 100, the subcircuit 100 including a chip of the type described in U.S. Pat. No. 5,744,922.

The Programmed Timer 24 is implemented via subcircuit 102, while the comparator subcircuit 28 is implemented with the subcircuit 106.

As mentioned above, it is necessary to spread out rising and falling edges (FIG. 7) in order to obtain reasonable separation within the response curve for the maintenance current. While this can be achieved, as mentioned above, by suitable adjustment of the programmed timer 24, it can also be achieved through use of "Hysteresis". In the embodiment of FIG. 9, this Hysteresis is obtained through use of an adjustable resistive arrangement 106, the resistive arrangement 106 permitting appropriate manipulation of the value of $V_{ref}$.

In one example, circuit 10*a* controls a 24 volt Guardian relay 12 and is implemented, at least in part, with a Vishay Siliconix Si9978 configurable H-Bridge Controller powered by a 24 volt.

Measurements were made with the 24-volt Guardian relay and a 24-volt Guardian solenoid. Using the control circuit 10*a* with the above-mentioned relay, power consumption was found to be reduced by as much as 75% relative to at least one conventional approach. Using the control circuit 10*a* with the above-mentioned solenoid, power consumption was found to be reduced by as much as 95% relative to at least one conventional approach.

Features of the above-described control circuit include:

Reduced consumption of energy during the maintenance of an electromechanical device, such as a relay, solenoid or clutch.

Reduced cost for related electromechanical components. With the disclosed embodiment, current supplied to maintain device activation can be maintained at a minimum. Accordingly, the disclosed embodiment permits a coil to be designed so as to dissipate only the power necessary for maintaining an actuated state. Moreover, the corresponding device may be (and need only be) over-powered for a short period of time to effect the actuation.

A standard device may be overpowered during actuation to improve its response, and then operated at lower power level to maintain actuated state.

Improvements in battery life in battery operated devices, such as forklift trucks, golf carts and electric vehicles as a result of using the disclosed embodiment.

Reduced heat generation and power consumption in a wide variety of devices (e.g. copiers, machine tools, vending machines, vehicles and household appliances) as a result of using the disclosed embodiment.

What is claimed is:

1. In an electromagnetic device with a coil in which the electromagnetic device is actuated with an actuating current and held in an operative condition by a holding current with the holding current being significantly lower in magnitude than the actuating current, a control circuit comprising:

a first transistor disposable in one of an off state and an on state, said first transistor communicating with said coil;

a second transistor disposable in one of an off state and an on state, said second transistor communicating with said coil, wherein during a powered mode, the first transistor is disposed in the on state and the second transistor is disposed in the off state, and, during a shorted mode, the first transistor is disposed in the off state and the second transistor is disposed in the on state;

a power source selectively communicating with the coil, wherein, during a first time interval, said power source communicates with said coil in the powered mode and, during a second time interval, said power source is disconnected from said coil in the shorted mode so that current is recirculated by said second transistor; and a switching actuator communicating with said first and second transistors, said switching actuator operating cooperatively with the first and second transistors to transition the holding current from a first magnitude to a second magnitude while maintaining the electromagnetic device in the operative condition.

2. The control circuit of claim 1, wherein each of the first and second transistors comprise a MOSFET device.

3. The control circuit of claim 1, further comprising an inverting device communicating with one of the first and second transistors so that the state of the first transistor is always different that the state of the second transistor.

4. The control circuit of claim 1, wherein said switching actuator includes a timer programmed to facilitate said transition of the holding current.

5. The control circuit of claim 1, further comprising a comparator communicating with said timer, said comparator causing one of the actuating and holding currents to be communicated to the coil.

6. The control circuit of claim 1, wherein the electromagnetic device comprises one of a solenoid, a relay and a magnetic clutch.

7. The control circuit of claim 1, wherein said switching actuator includes a sensing resistor with a resistor voltage, and wherein said transition of the holding current varies as a function of the resistor voltage.

8. The control circuit of claim 7, wherein said switching actuator further includes a comparator communicating with the sensing resistor, wherein said comparator outputs a transition signal, for causing said transition of the holding current, when the resistor voltage is one of greater than and less than a reference voltage.

9. In an electromagnetic device with a coil in which the electromagnetic device is actuated with an actuating current and held in an operative condition by a holding current with the holding current being significantly lower in magnitude than the actuating current, a method comprising:

providing a first transistor disposable in one of an off state and an on state, said first transistor communicating with said coil;

providing a second transistor disposable in one of an off state and an on state, said second transistor communicating with said coil, wherein during a powered mode, the first transistor is disposed in the on state and the second transistor is disposed in the off state, and, during a shorted mode, the first transistor is disposed in the off state and the second transistor is disposed in the on state;

during a first time interval, communicatively coupling a power source with the coil in the powered mode and, during a second time interval, disconnecting the power source from the coil in the shorted mode; and using the first and second transistors to transition the holding current from a first magnitude to a second magnitude while maintaining the electromagnetic device in the operative condition.

* * * * *